US005216875A

United States Patent [19]

Kennelly et al.

[11] Patent Number: 5,216,875

[45] Date of Patent: * Jun. 8, 1993

[54] CATALYTIC COMBUSTION PROCESS USING SUPPORTED PALLADIUM OXIDE CATALYSTS

[75] Inventors: Teresa Kennelly, Belle Mead; Robert J. Farrauto, Westfield, both of N.J.

[73] Assignee: Engelhard Corporation, Iselin, N.J.

[ * ] Notice: The portion of the term of this patent subsequent to Jan. 16, 2007 has been disclaimed.

[21] Appl. No.: 852,371

[22] Filed: Mar. 13, 1992

Related U.S. Application Data

[63] Continuation-in-part of Ser. No. 776,907, Oct. 16, 1991, which is a continuation of Ser. No. 465,678, Jan. 16, 1990, abandoned, which is a continuation-in-part of Ser. No. 234,660, Aug. 22, 1988, Pat. No. 4,893,465.

[51] Int. Cl.[5] ..... F02C 1/00; F02G 3/00

[52] U.S. Cl. ..... 60/39.02; 60/39.06; 60/723; 423/213.5; 431/2

[58] Field of Search ..... 60/723, 39.141, 746, 60/39.02, 39.06; 431/7, 2; 423/213.5; 502/38

[56] References Cited

U.S. PATENT DOCUMENTS

| | | | |
|---|---|---|---|
| 2,941,954 | 6/1960 | Wilkes | 502/38 |
| 3,357,915 | 12/1967 | Young | 502/38 |
| 3,384,656 | 5/1968 | McMahon | 502/38 |
| 3,873,472 | 3/1975 | Oshima et al. | 423/213.5 |
| 3,919,120 | 11/1975 | Kato et al. | 423/213.5 |
| 3,926,842 | 12/1975 | Suggitt et al. | 502/38 |
| 3,987,080 | 10/1976 | Barmby | 502/38 |
| 3,993,572 | 11/1976 | Hindin et al. | 252/462 |
| 4,056,489 | 11/1977 | Hindin et al. | 252/462 |
| 4,112,675 | 9/1978 | Pillsbury et al. | 60/723 |
| 4,170,573 | 10/1979 | Ernest et al. | 252/462 |
| 4,202,168 | 5/1980 | Acheson et al. | 60/723 |
| 4,425,255 | 1/1984 | Toyoda et al. | 502/38 |
| 4,534,165 | 8/1985 | Davis, Jr. et al. | 60/723 |
| 4,791,091 | 12/1988 | Bricker et al. | 502/303 |
| 4,795,845 | 1/1989 | Martindale | 502/38 |

*Primary Examiner*—Richard A. Bertsch
*Assistant Examiner*—T. Thorpe

[57] ABSTRACT

A process for operating a palladium oxide-containing catalytic combustor is useful, e.g., for powering a gas turbine. The palladium oxide is supported on a metal oxide such as alumina, lanthanide metal oxide-modified alumina, ceria, titania or tantalum oxide. The method involves maintaining control of the temperature within the combustor in such a manner as to insure the presence of palladium oxide. By maintaining the temperature below the decomposition onset temperature of palladium oxide (which is catalytically active for catalytic combustion) into metallic palladium (which is catalytically inactive) deactivation of the catalyst is avoided and high catalytic activity is retained. Regeneration of catalyst following inactivation resulting from an over-temperature is accomplished by using a heat soak in a regeneration temperature range which varies depending on the particular metal oxide used to support the palladium oxide.

33 Claims, 2 Drawing Sheets

CATALYTIC COMBUSTION PROCESS USING SUPPORTED PALLADIUM OXIDE CATALYSTS

CROSS-REFERENCE TO RELATED APPLICATIONS

This application is a continuation-in-part of Ser. No. 776,907 filed Oct. 16, 1991, which is a continuation of Ser. No. 465,678 filed Jan. 16, 1990, now abandoned, which was a continuation-in-part of Ser. No. 07/234,660 filed Aug. 22, 1988, now U.S. Pat. No. 4,893,465.

BACKGROUND OF THE INVENTION

1. Field of the Invention

The present invention relates to a particularly advantageous process for the catalytically supported combustion of carbonaceous materials, including natural gas and methane. In a more specific aspect, this invention relates to a process for catalytically-supported combustion of natural gas or methane using a supported palladium oxide catalyst, without the formation of substantial amounts of nitrogen oxides.

Burning of carbonaceous fuels is associated with formation of air pollutants, among the most troublesome of which are nitrogen oxides (NOx). Nitrogen oxides form whenever air-supported combustion takes place at open flame temperatures. One approach to eliminating nitrogen oxides involves chemically modifying the oxides after their formation. This approach has drawbacks, including the high cost associated with attempting to eliminate 100% of a once-formed pollutant. A more direct method of eliminating nitrogen oxides is to operate the combustion process at a lower temperature so that no formation of nitrogen oxide occurs. Such low temperature combustion can take place in the presence of catalysts, and it is to such a low temperature combustion process that this invention is directed.

In general, conventional adiabatic, thermal combustion systems (e.g., gas turbine engines) operate at such high temperatures in the combustion zone that undesirable nitrogen oxides, especially NO, are formed. A thermal combustion system operates by contacting fuel and air in flammable proportions with an ignition source, e.g., a spark, to ignite the mixture which will then continue to burn. Flammable mixtures of most fuels burn at relatively high temperatures, i.e., about 3,300° F. and above, which inherently results in the formation of substantial amounts of NOx. In the case of gas turbine combustors, the formation of NOx can be reduced by limiting the residence time of the combustion products in the combustion zone. However, due to the large quantities of gases being handled, undesirable quantities of NOx are nonetheless produced.

It has long been realized that little or no NOx is formed in a system which catalytically burns a fuel at relatively low temperatures as compared to uncatalyzed thermal combustion. Typically, such catalytic combustion of natural gas or methane, for example, utilizes a preburner or thermal combustor which employs flame combustion to preheat combustion air to a temperature of 700° C. or higher. Once the catalyst is sufficiently hot to sustain catalysis, the preburner is shut down and all the fuel and air are directed to the catalyst. Preheat is then only due to compressor discharge. Such a catalytic combustor, if operated at temperatures below about 1,300° C.-1,400° C., avoids the nitrogen oxide formation which occurs at the higher temperatures which are characteristic of the flame combustion. A description of such a catalytic combustion process and apparatus is found, for example, in U.S. Pat. No. 3,928,961. See also U.S. Pat. Nos. 4,065,917 and 4,019,316.

Such catalytic combustion as described above which will function effectively at a high space velocity has, however, heretofore been generally regarded as commercially unattractive. A primary reason for this lack of commercial attractiveness has been the absence of an economically competitive method for catalytic combustion of natural gas.

2. Description of Related Art

Catalytically supported combustion processes have been described in the prior art. See, e.g., Pfefferle, U.S. Pat. No. 3,928,961. The use of natural gas or methane in catalytic combustion has been taught in the art, as has the use of a palladium catalyst to promote such combustion/oxidation. See Cohn, U.S. Pat. No. 3,056,646 wherein the use of palladium catalyst to promote methane oxidation is generically disclosed, as is an operable temperature range, 271° C. to 900° C. (see column 2, lines 19-25). Note also that this Patent states "the higher the operating temperature, the shorter will be the catalyst life and the more difficult will be subsequent ignition after catalyst cooling". Other patents directed to the use of platinum group metals as catalysts for methane oxidation at temperatures above 900° C. include U.S. Pat. Nos. 3,928,961; 4,008,037; and 4,065,917. The literature also describes the thermal decomposition of PdO to Pd metal at temperatures of 800° C. in air at atmospheric pressure. See *Kirk Othmer Encyclopedia of Chemical Technology*, Vol. 18, p. 248 which states that palladium acquires a coating of oxide when heated in air from 350° C. to 790° C. but that above this temperature the oxide decomposes and leaves the bright metal.

The present invention finds particular utility in a process for the start-up of catalytically supported combustion. Prior art references directly related to such start-up are Pfefferle, U.S. Pat. No. 4,019,316 and Pfefferle, U.S. Pat. No. 4,065,917.

C. L. McDaniel et al, "Phase Relations Between Palladium Oxide and the Rare Earth Sesquioxides in Air," *Journal of Research of the Natural Bureau of Standards—A. Physics and Chemistry*, Vol. 72A, No. 1, January-February, 1968, pages 27-37, describe complexes of PdO and other rare earth oxides. Specifically, the paper describes PdO in combination with each of the following sesquioxides $La_2O_2$, $Eu_2O_3$, $Gd_2O_3$, $Dy_2O_3$, $Ho_2O_3$, $Y_2O_3$, $Er_2O_3$, $Tm_2O_3$, $Yb_2O_3$ and $Lu_2O_3$.

A. Kato et al, "Lanthanide B-Alumina Supports For Catalytic Combustion Above 1,000° C.," *Successful Design of Catalysts*, 1988, Elsevier Science Publishers, pages 27-32, describes the preparation of support materials consisting of lanthanide oxides and alumina for use as combustion catalysts. The preparation comprises preparing a mixed solution of a lanthanide element nitrate (e.g., a nitrate of Y, La, Ce, Pr, Nd, Sm, etc.) and $Al_2(NO_3)_3$, neutralizing the solution by adding dilute aqueous ammonia to form a precipitate, and washing, drying and calcining the precipitate at 500° C. The powder, with 1% added graphite, was formed into cylindrical tablets and calcined at 700° C. The resultant support was impregnated with a solution of $Pd(NO_3)_2$ to provide 1% by weight Pd, then calcined at 500° C., then at 1,200° C. The article states that the use of La, Pr and Nd as the lanthanide element gave rise to B-alumina (page 28) and that endurance tests on methane combustion performed at 1,200° C. demonstrated that a Pd catalyst supported on lanthanum B-alumina has good durability and resistance to thermal sintering (pages 31 and 32).

SUMMARY OF THE INVENTION

Generally, one aspect of the present invention is directed to a method for operating a catalytic combustor using a palladium-containing catalyst and using a novel set of unexpectedly effective operating parameters which permits high catalytic activity, and results in on-going retention and regeneration of such activity.

Another general aspect of the present invention provides a process for catalytic combustion which involves the discovery that the temperatures of palladium oxide decomposition and recombination may be varied depending on the metal oxide support used for the palladium oxide, and the present invention is directed to utilizing this variation to optimize catalytic combustion processes.

More specifically, in accordance with the present invention there is provided a process for starting a combustion system to catalytically combust a gaseous carbonaceous fuel (for example, a gas comprising methane, e.g., natural gas or some other methane-rich gas) with air in a combustor in the presence of a palladium oxide-containing catalyst. The process comprises the following steps. A decomposition onset temperature at which the palladium oxide-containing catalyst decomposes at an oxygen partial pressure equal to that found in the combustor is predetermined. A reformation onset temperature at which the palladium oxide-containing catalyst will, at the same oxygen partial pressure found in the combustor, reform into palladium oxide after being subjected to the decomposition temperature is also predetermined. A flow of hot gases from a preburner is utilized to heat the catalyst to a temperature high enough to initiate combustion of the fuel with air upon contact thereof with the catalyst. Thereafter, the flow of hot gases from the preburner is reduced while supplying air and the fuel for combustion to the combustor downstream of the preheater. Upon overheating of the catalyst (whether by the preburner hot gases or otherwise, e.g., during combustion operation) to a first temperature in excess of the decomposition onset temperature of the catalyst, whereby the catalyst sustains a diminution of catalytic activity, catalytic activity is thereafter restored by lowering the temperature of the catalyst to a temperature not greater than the reformation onset temperature and maintaining the temperature at or below the reformation onset temperature until a desired degree of catalytic activity of the catalyst is achieved, and then maintaining the catalyst below the aforesaid decomposition onset temperature.

In one aspect of the present invention, the palladium oxide is supported on a metal oxide selected from the group consisting of ceria, titania, tantalum oxide, lanthanide metal oxide-modified alumina and mixtures of two or more thereof. The lanthanide metal oxide-modified alumina may be, for example, a lanthanum oxide-modified alumina, a cerium oxide-modified alumina or a praseodymium oxide-modified alumina, or mixtures of two or more thereof.

Another aspect of the present invention provides a process for starting a combustion system to catalytically combust a carbonaceous fuel with air in a combustor in the presence of a palladium oxide supported on a metal oxide support. The process comprises utilizing a flow of hot gases from a preburner to heat the catalyst to a temperature high enough to initiate combustion of the fuel with air upon contact thereof with the catalyst, and thereafter reducing the flow of hot gases from the preburner while supplying air and fuel for combustion to the combustor downstream of the preheater. Upon heating of the catalyst to a first temperature in excess of at least about 775° C. (whether by the preheater or otherwise, e.g., during combustion operation), at which first temperature catalyst deactivation occurs, catalytic activity is thereafter restored by lowering the temperature of the catalyst to a catalyst reactivation temperature which is lower than about 735° C., and maintaining the temperature at or below the catalyst reactivation temperature until desired catalytic activity is achieved. The temperature of the catalyst is then maintained below about 735° C.

Yet another aspect of the present invention provides for a process for catalytic combustion of a mixture of a gaseous carbonaceous fuel and air by contacting the mixture with a metal oxide-supported palladium oxide catalyst, wherein the catalyst for the catalytic combustion has been subjected to a temperature in excess of the temperature at which deactivation of the catalyst occurs, which temperature is at least about 775° C. at atmospheric pressure. The present invention provides an improvement comprising restoring catalytic activity of the catalyst by lowering the temperature of the catalyst into a regenerating temperature range at least about 44° C. below the deactivation temperature, and maintaining the temperature within that range for a time sufficient to restore catalytic activity to said catalyst. As described below, different catalyst deactivation temperatures, different catalyst reactivation onset temperatures, and different temperature ranges below the deactivation temperature may be employed depending on the particular metal oxide support employed in the catalyst.

Another aspect of the present invention provides for employing the combustion effluent discharged from the combustor to run a gas turbine.

The present invention also provides a process for the catalytically supported combustion of a gaseous carbonaceous fuel which comprises the following steps. A mixture of the fuel and oxygen is formed to provide a combustion mixture, and the combustion mixture is contacted under conditions suitable for catalyzed combustion thereof with a catalyst composition comprising a catalytic material consisting essentially of a catalytically effective amount of palladium oxide dispersed on a metal oxide support selected from the group consisting of ceria, titania, tantalum oxide and lanthanide oxide-modified alumina.

Other aspects of the invention, including selecting specific metal oxide supports for the palladium oxide catalyst to establish specified decomposition and reformation temperatures, are set forth below in the Detailed Description of the Invention and Preferred Embodiments Thereof.

DETAILED DESCRIPTION OF THE INVENTION AND PREFERRED EMBODIMENTS THEREOF

Figure 1:
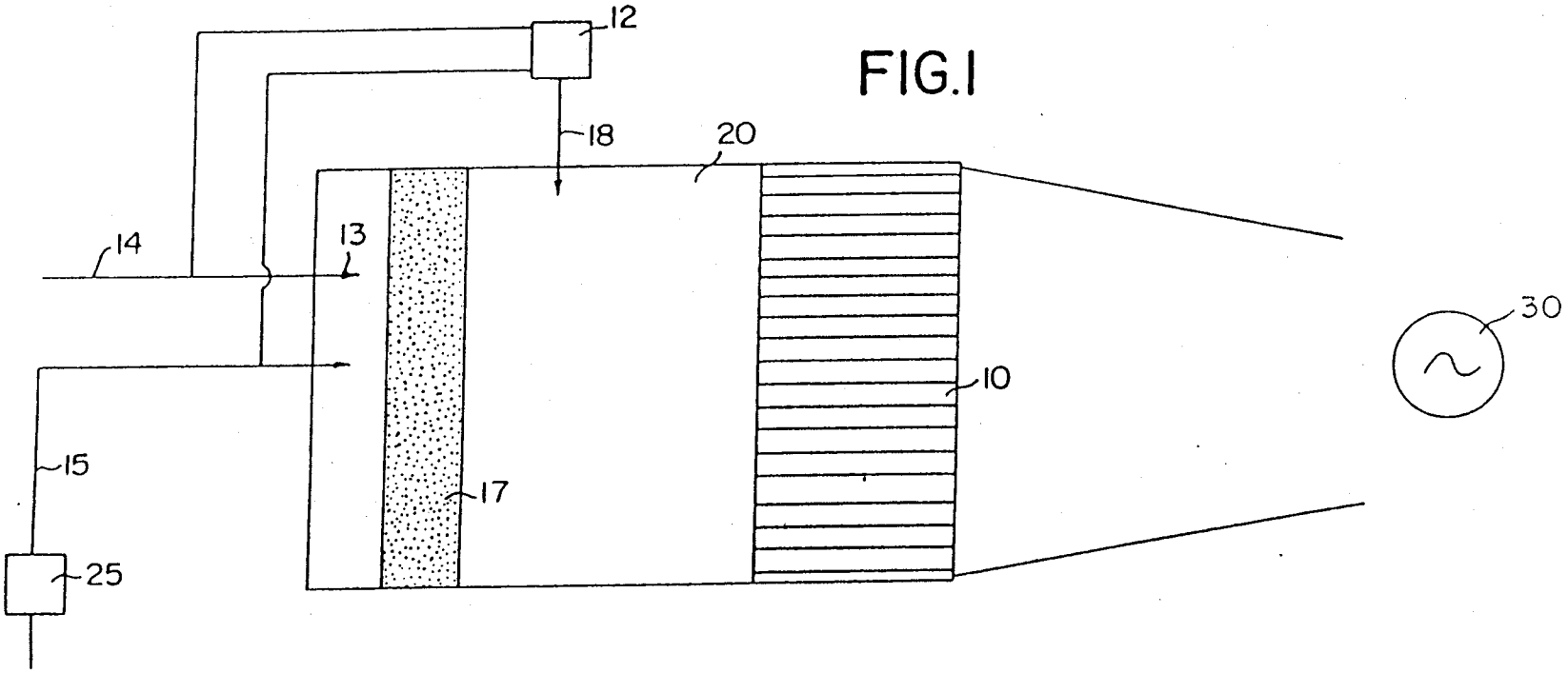
FIG. 1 is a partial schematic breakaway view of a preburner/catalytic combustor system which is operable in accordance with one embodiment of the present invention.

At atmospheric pressure palladium-containing catalysts are known to lose activity when subjected to temperatures in excess of about 800° C., at which temperatures palladium oxide decomposes into palladium metal. The interaction of palladium oxide with reducing agents exacerbates such decomposition into palladium metal. One aspect of the present invention is concerned with compensating for an over-temperature event (or a continuing series of such over-temperature events) which causes catalyst deactivation. In the event of such over-temperature, the present invention utilizes procedures for regeneration of the catalyst, in situ. For example, using a typical palladium on alumina catalyst, when start-up or operation of the catalytic combustor results in exposing the ignition catalyst to a temperature in excess of about 800° C. at atmospheric pressure, resulting in loss of catalyst activity, the over-temperature is, according to the present invention, followed by an atmospheric pressure regenerating temperature soak between about preferably 530° C. to 650° C. and more preferably 560° C. to 650° C., which oxidizes the palladium on alumina to active palladium oxide. Even if the entire catalytic combustor does not reach a catalyst inactivating over-temperature, isolated hot spots within the catalytic combustor may be subjected to an over-temperature, and the heat soak of the present invention will provide a catalyst regenerating benefit. Thus, a regenerating temperature soak according to the present invention unexpectedly regenerates the activity lost due to an over-temperature in all or part of the combustor.

As those skilled in the art will appreciate, the above-stated temperature ranges are dependent on the partial pressure of oxygen. At higher pressures, as for example might be encountered in conjunction with generation of combustion effluent useful for operation of gas turbines, the decomposition temperature at which palladium oxide will decompose into metallic palladium will increase, as will the regeneration temperature at which palladium oxide will reform. References hereinafter to these temperatures are all at atmospheric pressures, it being understood that at enhanced partial pressure of oxygen the decomposition and regenerating temperatures will shift upwardly, and that the determination of such increased temperatures at higher oxygen partial pressures will be a matter well known to those skilled in the art.

In a method of the present invention for operating a palladium oxide-containing catalytic combustor useful, e.g., for powering a gas turbine, control of the temperature is maintained within the catalytic combustor in such a manner as to insure the presence of palladium oxide, which is catalytically active for the catalytic combustion reaction. By maintaining the temperature below about 800° C., decomposition into metallic palladium of palladium oxide supported on an unmodified alumina support is avoided and high catalytic activity is maintained. However, in the event of an over-temperature, or reduction of palladium oxide as a result of chemical interaction with a reducing agent, such as an excess of fuel, regeneration following inactivation due to loss of PdO can be accomplished by bringing a deactivated catalyst comprising palladium on an alumina support to a temperature within the regenerating temperature range of about preferably 530° C. to 650° C., and more preferably 560° C. to 650° C., where reoxidation occurs at a reasonable rate.

Further, according to the present invention, the temperatures of palladium oxide decomposition, and the temperatures of palladium oxide reformation are varied by changing or modifying the metal oxide support used for the palladium oxide. The temperature ranges stated above are those which are effective for palladium on an unmodified alumina support. However, the temperature for reformation of palladium oxide is, to an extent, dependent on the metal oxide used to support the palladium, and other suitable metal oxide support materials, such as ceria, titania and tantalum oxide, and modified alumina supports, such as alumina modified with cerium oxide, lanthanum oxide and praseodymium oxide, have characteristic temperatures at which palladium oxide thereon will decompose and recombine. These characteristic temperatures, which can be determined by those skilled in the art by means such as, for example, thermogravimetric analysis, permit the selection of appropriate metal oxide support materials, and thus provide control over palladium oxide decomposition/reformation temperature ranges.

FIG. 1 schematically depicts apparatus for carrying out catalytic combustion using a combustor having a precombustion chamber 20 fed via line 15 with air supplied from a compressor 25, and supplied with fuel from a nozzle 13 connected to fuel line 14. The fuel and air together pass through a mixer 17 prior to entering the precombustion chamber 20. Feeding into the precombustion chamber via injector line 18 is a preburner 12, also connected to the air line 15 and fuel line 14. Preburner 12 sprays hot combustion gases into chamber 20 from injector line 18. The catalyst is positioned on a supporting monolith 10 from which the hot combustion gases move downstream to drive turbine 30.

EXAMPLE 1

The procedure used to obtain the data graphed in FIG. 2 was as follows. First, a sample of a conventional palladium on aluminum oxide catalyst was prepared according to a standard procedure, viz., gamma alumina was calcined at 950° C. for 2 hours and then screened to particle sizes between 53 and 150 microns. This gamma alumina was used as a catalyst carrier. The use of gamma alumina as a catalyst carrier in this example was, as those skilled in the art will readily appreciate, simply a matter of choice. Other suitable carriers include, for example, modified alumina (i.e., aluminas which contain surface area stabilizers such as silica, barium oxide, lanthanum oxide and cerium oxide) silica, zeolites, titania, zirconia and ceria as well as mixtures of the foregoing. As described below, certain of these modified aluminas as well as other supports such as ceria, titania and tantalum oxide enable adjustment of the palladium oxide decomposition/reformation temperature ranges to desired levels. In any case, ten grams of the described (unmodified) alumina carrier was impregnated with a $Pd(NO_3)_2 \cdot 2H_2O$ solution by the incipient wetness method to give approximately 4 wt% Pd on the finished catalyst. The Pd was then fixed on the catalyst by a conventional reduction with an aqueous hydrazine solution. The reduced catalyst was dried at 120° C. overnight and calcined at 500° C. for 2 hours to give what will hereafter be designated as "fresh catalyst".

Figure 2:
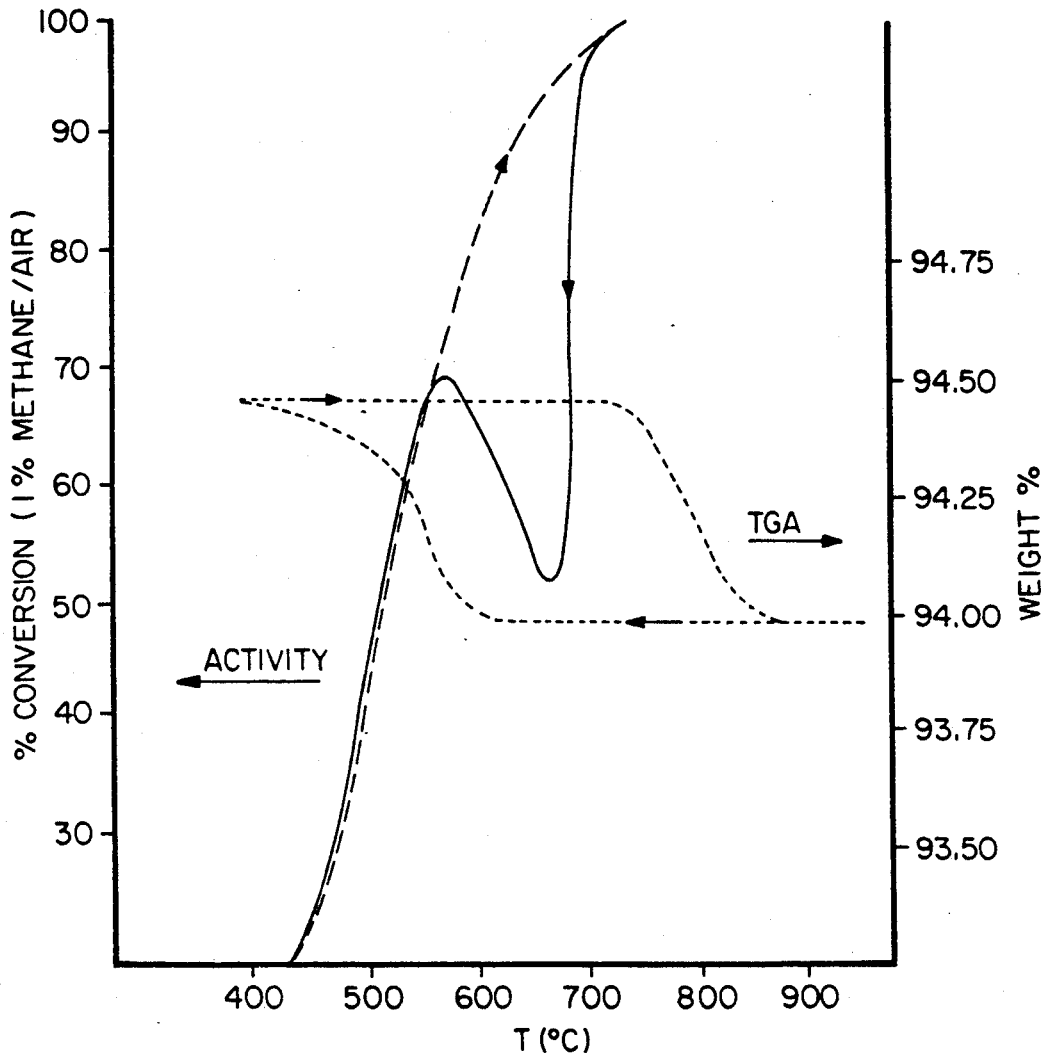
FIG. 2 is a thermogravimetric analysis (TGA) plot of temperature plotted on the abscissa versus percentage change in sample weight in air plotted on the right-hand ordinate. Superimposed on the TGA plot is a plot of percent conversion of 1% methane in air (an index of activity) on the left-hand ordinate versus the temperature on the abscissa.

The TGA profile of FIG. 2 was generated by heating this fresh PdO on $Al_2O_3$ catalyst in air at 20° C./min. The heating portion of the graph depicts a weight loss above about 800° C. where decomposition of PdO to Pd metal occurs. Following decomposition, heating continued to 1100° C. where it was held for 30 minutes.

The temperature program was then reversed allowing the catalyst to cool in air. Unexpectedly, no weight increase due to re-oxidation of the Pd metal was observed until about 650° C., below which a sharp increase was observed which plateaus at about 560° C. to 530° C. Upon continued cooling below 530° C. there was a small but steady weight increase down to room temperature. Repeated heating and cooling cycles of the same sample demonstrates the same temperature-dependent weight changes.

Referring to other data graphed on FIG. 2, the percent conversion plot as read on the left ordinate of FIG. 2 is a measure of catalytic activity.

The procedure used to obtain the graphed data on catalytic activity was as follows: a 0.06 gram ("g") sample of catalyst, prepared as described above, was mixed with 2.94 g of a diluent (alpha-alumina) which had been screened to a particle size range of from 53 to 150 microns. The resultant 3 g catalyst charge was supported on a porous quartz frit in a 1" diameter quartz reactor tube. The tube was then positioned vertically in a programmable tube furnace. A thermocouple was positioned axially in the catalyst bed for continuous monitoring and connections to a gas (fuel) stream secured. A fuel mixture of 1% methane in zerograde air (air containing less than 5 parts per million by weight $H_2O$ and less than 1 part per million by weight hydrocarbon calculated as $CH_4$) metered by a mass flow controller was flowed through the system at a rate of 3 liters per minute. The use of methane as a fuel was, as those skilled in the art will readily appreciate, simply a matter of choice. Other suitable fuels would include, for example, natural gas, ethane, propane, butane, other hydrocarbons, alcohols, other carbonaceous materials, and mixtures thereof. The term "carbonaceous materials" or "carbonaceous fuels" includes each of the foregoing. The gas exiting the reactor was analyzed by a Beckman Industrial Model 400A Hydrocarbon Analyzer. The analyzer was zeroed on air and spanned to 100% on the fuel mixture at ambient conditions. The procedure was initiated by ramping the furnace to a selected maximum temperature. This temperature was held for a limited time and then the furnace was shut off and the reactor permitted to cool. A multi-channel strip chart simultaneously recorded the catalyst bed temperature and the concentration of hydrocarbon in the exit gas stream. This data thus provided a profile of the temperature dependence of methane oxidation/combustion.

The activity of the catalyst, as determined by the percent conversion of the methane fuel, was measured at various increasingly higher temperatures and the results were plotted as the dashed line in FIG. 2. FIG. 2 shows that at progressively higher temperatures the percent conversion of the methane becomes greater, until at approximately 800° C. the conversion becomes essentially 100%. At this temperature, the reaction in effect became a thermal reaction as opposed to a catalytic reaction. The activity data in FIG. 2 also demonstrates that the continuous, rapid increase in percent conversion with an increase in temperature is followed by a rapid decrease in percent conversion with a reduction in temperature. The decrease in percent conversion (or activity) undergoes a reversal below about 700° C. during a cooling cycle, at which point percent conversion (activity) begins to increase until a temperature of about 600° C. is obtained. At that point, the catalyst again demonstrated the same activity as the catalyst had initially demonstrated (during the heating cycle) at that temperature. This observation was made for all repeated cycles.

EXAMPLE 2

Further samples of PdO on $Al_2O_3$ were pre-calcined in air for 17 hours to 1100° C. followed by cooling in air to room temperature. TGA profiles of these samples were qualitatively identical to second cycles of fresh samples. Thus, in both cases the PdO decomposes to Pd metal during heat-up, and PdO forms below about 650° C. during cool down.

EXAMPLE 3

PdO powder was prepared using the identical procedure as for PdO on $Al_2O_3$. Heating of this sample clearly showed only one weight loss process between 810° C. and 840° C. in which the PdO decomposes to Pd metal. The weight loss observed, approximately 13%, is consistent with decomposition of PdO to Pd.

EXAMPLE 4

Samples of $PdO/Al_2O_3$ were calcined to 1,100° C. in air and evaluated for activity as a function of temperature as described above. During heat-up, conversion was first noted at about 340° C. and slowly rose to 30% at about 430° C. after which percent conversion rapidly increased with temperature up to 90% at about 650° C. Above this temperature the thermal process became significant. The furnace ramp continued to increase catalyst temperature up to 1,000° C., well beyond the temperature of decomposition of PdO to Pd metal. The temperature was then reduced and the sample cooled in $CH_4$/air. At about 720° C. the thermal process began to extinguish and the conversion fell far below the conversion observed during heat-up, demonstrating that the catalyst had lost activity. The catalyst activity at this point became virtually zero.

As the $Pd/Al_2O_3$ continued to cool and the conversion due to the thermal component decreased to about 50%, there was a sudden unexpected increase in activity at about 680° C. and a maximum activity of about 70% at 650° C. The conversion curve upon continued cooling effectively overlaps that generated during heat-up.

The TGA profile on a sample of the same catalyst, calcined to 1,100° C. in air for 17 hours clearly showed decomposition of PdO to Pd metal during heating. Upon cooling the large hysteresis in re-oxidation is observed to occur around 650° C. and is complete at 575° C., closely tracking the activity performance.

EXAMPLE 5

A sample of fresh PdO on $Al_2O_3$ was heated in air to 950° C., well beyond the range where any weight loss occurred. The sample was then cooled to 680° C. and held at that temperature for 30 minutes. No weight gain occurred. The sample was then cooled to 650° C. at which temperature weight gain commenced. This example thus demonstrates that the hysteresis depicted in FIG. 2 is a temperature dependent process, not a rate process.

EXAMPLE 6

A sample of fresh PdO on $Al_2O_3$ catalyst was heated in air to 950° C., and then cooled to 680° C. and held at that temperature for 30 minutes as in Example 5. The activity of the catalyst as indicated by its ability to catalyze the combustion of 1% methane in air was then measured. The catalyst was then cooled to 650° C. and its activity again measured. The activity at 650° C. was much greater than at 680° C., again demonstrating that the hysteresis depicted in FIG. 2 is a temperature dependent process, not the result of a rate process.

EXAMPLE 7

The dependence of palladium oxide decomposition temperature and reformation temperature on the metal oxide support was established by preparing samples of palladium on alumina, on tantalum oxide, on titania, on ceria and on zirconia and measuring in air decomposition and reformation temperatures using thermogravimetric analysis.

The method of preparation for the five samples shown below in TABLE I was as follows:

A. 4 wt % Pd/Alumina

Alumina sold under the trademark CATAPAL SB by Vista Chemical Company was calcined at 950° C. for 2 hours and then sieved to 53 to 150 micron particle size; 9.61 g of the alumina was impregnated with an aqueous solution of palladium nitrate using the incipient wetness technique. The palladium was then reduced using aqueous hydrazine. This material was dried at 110° C. overnight and then calcined at 500° C. for 2 hours in air to produce the finished catalyst.

B. 4 wt % Pd/Ceria 5 g of SKK cerium oxide ($CeO_2$) was impregnated with palladium nitrate as was done for the previous sample, adjusting the total volume of the impregnating solution to the incipient wetness of the support. The sample was then reduced, dried, and calcined at 500° C. for 2 hours in air as was done for the Pd on alumina sample.

C. 4 wt % Pd/Zirconia

A 5 g sample of commercially available zirconia (Magnesium Elecktron SC101 Grade) was impregnated with palladium and handled just as was the Pd/ceria sample.

D. 4 wt % Pd/Titania

A sample of commercially available titania was calcined at 950° C. for 2 hours and 8.2 g was then impregnated with palladium and handled just as was the Pd/ceria sample.

E. 4 wt % Pd/Tantalum Oxide

A 5 g sample of commercially available tantalum oxide ($Ta_2O_5$) (Morton Thiokol) was impregnated with palladium just as was the Pd/ceria sample. The low incipient wetness of this material required a two-step impregnation with a drying step in between. The rest of the preparation was the same as for the Pd/ceria.

The TGA profile of the catalysts was generated as described above with respect to the TGA profile of FIG. 2, that is, by heating the fresh catalyst samples in air at a rate of 20° C. per minute. The results attached are set forth in TABLE I.

TABLE I

Decomposition and Reformation Temperatures for Palladium on Various Metal Oxide Supports

| Catalyst | Degrees Centigrade | | |
|---|---|---|---|
| | $T_D$(1) | $T_R$(2) | $T_D$-$T_R$(3) |
| 4% $PdO/Al_2O_3$ | 810 | 600 | 210 |
| 4% $PdO/Ta_2O_5$ | 810 | 650 | 160 |
| 4% $PdO/TiO_2$ | 814 | 735 | 80 |
| 4% $PdO/CeO_2$ | 775 | 730 | 44 |
| 4% $PdO/ZrO_2$ | 682 | 470 | 212 |

(1)$T_D$ = Decomposition onset temperature of PdO to Pd
(2)$T_R$ = Reformation onset temperature of Pd to PdO
(3)$T_D$-$T_R$ represents the hysteresis discussed above.

TABLE I lists the temperature ($T_D$) for onset of PdO decomposition to Pd, the temperature ($T_R$) for onset of reformation of PdO and the hysteresis equal to the differences ($T_D-T_R$), all at atmospheric pressure in air for palladium oxide supported on five different metal oxides. TABLE I shows that palladium oxide on alumina, tantalum oxide, titania, and ceria supports exhibits little variation in decomposition temperature. However, the choice of metal oxide does result in a pronounced effect on the reformation temperature. The differences between decomposition onset and reformation onset temperatures ($T_D-T_R$) vary from 210° C. for $Al_2O_3$ to 44° C. for the $CeO_2$ supported palladium. Typically, the smaller this difference (and the higher the reformation onset temperature), the easier it is to regenerate activity in a gas turbine. Accordingly, for catalyst compositions containing one of the catalysts of TABLE I which are over-temperatured so as to sustain deactivation, the catalytic activity may be restored by lowering the temperature of the catalyst into a reformation onset temperature range which is lower than $T_R$ for the metal oxide support employed, and thereafter maintaining the temperature of the catalyst below about $T_D$ for the metal oxide support employed.

The last metal oxide support listed in TABLE I is $ZrO_2$. As seen from TABLE I, zirconia promotes premature decomposition of PdO to Pd at 682° C. and inhibits reformation to a low temperature of 470° C. This catalyst, therefore, has a large range and a relatively low temperature at which Pd metal is stable in an oxidizing environment. This is not a desirable property for methane oxidation.

These Examples 7A–7E demonstrate that activity of a palladium oxide-containing catalyst, as measured by its ability to promote the oxidation of methane, can be preserved by utilizing the catalyst at temperatures below the palladium oxide decomposition temperature which is the temperature at which catalyst deactivation will occur; and that, if activity is lost through over-temperature, activity can be restored by subjecting the deactivated catalyst to a heat soak at an effective temperature which depends on the metal oxide support being used with the palladium, and which effective temperature is below that at which onset of reformation of PdO occurs. This applies as well to modified alumina-supported catalysts, which are prepared by impregnating alumina with a suitable, e.g., nitrate, form of the rare earth metal. The alumina supports employed to prepare the supported catalysts comprised primarily gamma-alumina but calcination during catalyst preparation caused the formation of other phases, such as the beta, kappa, delta and theta forms of alumina, which, together with the gamma form, were present in the finished supports. A fixed weight of the alumina is impregnated with, e.g., a lanthanum nitrate, cerium nitrate or praseodymium nitrate, or mixtures thereof, by mixing the solution of the nitrate with the alumina and then adding palladium to the composite after calcination.

After addition of the rare earth metal nitrate solution to the alumina, the sample is calcined in air, for example, at temperatures in excess of about 950° C. for a time period of at least 2 hours. Palladium is then added by the incipient wetness technique using a palladium nitrate solution. The sample is then reduced with aqueous hydrazine, dried and then calcined in air at temperatures in excess of about 500° C. for a time period of at least 2 hours. If a high palladium concentration is desired in the catalyst composition, the impregnation step with palladium nitrate is repeated.

The catalyst composition of this invention may also be prepared by impregnating with a suitable solution of a palladium salt a rare earth oxide-modified alumina. Such modified alumina is one which has been previously impregnated with a solution of a rare earth metal compound and then calcined according to methods known in the art, usually at temperatures in excess of 500° C., to provide a rare earth oxide-modified alumina. The atomic ratio of palladium to the rare earth metal used to modify the alumina is generally from about 1:2 to about 4:1; preferably it is from about 1:2 to about 1:1 for lanthanum-modified alumina; from about 1:1 to about 4:1 for cerium-modified alumina; and from about 1:2 to about 2:1 for praseodymium-modified alumina. Generally, when modified alumina is employed as the metal oxide support for the palladium oxide the decomposition temperature of palladium oxide which, at atmospheric pressure, is about 800° C. for palladium oxide on unmodified alumina as discussed above, is shifted to a temperature range of about 920° C. to 950° C. Palladium oxide supported on modified alumina in accordance with this aspect of the invention shows good activity for catalyzing the combustion of carbonaceous gaseous fuels and stability of the catalyst at operating temperatures which may safely be set at, for example, 900° C.

The following examples illustrate the use of modified alumina supports for the palladium oxide catalyst.

EXAMPLE 8

A. 1.74 grams of $Ce(NO_3)_3 \cdot 6H_2O$ was dissolved in 3 milliliters of deionized water and the resulting solution was added to 10.01 grams of gamma alumina powder sold under the trademark CATAPAL by Vista Chemical Company. The wetted alumina powder was dried overnight at 110° C. and then calcined in air at 950° C. for two hours to provide a ceria-modified alumina. A quantity of 3.43 grams of palladium nitrate solution (10 weight percent Pd) was diluted with 1.7 grams of deionized water and then added to the ceria-modified alumina. Aqueous hydrazine was then added to reduce the palladium on the support. The mixture was then dried at 110° C. for 17 hours and then calcined in air at 500° C. for 2 hours to provide the sample of TABLE II containing 0.004 moles of each of Pd and Ce, i.e., Pd and Ce in a 1:1 molar ratio.

B. The procedure of Part A was repeated with different appropriate amounts of cerium nitrate and palladium nitrate impregnation to provide the other ceria-modified alumina supported catalysts of TABLE II containing the indicated molar amounts of Ce and Pd.

EXAMPLE 9

The procedure of Example 8 was exactly repeated except that $La(NO_3)_3 \cdot 6H_2O$ in appropriate amounts was used in place of the $Ce(NO_3)_3 \cdot 6H_2O$ to provide the lanthana-modified alumina samples of TABLE II containing the indicated molar amounts of La and Pd.

EXAMPLE 10

The procedure of Example 8 was exactly repeated except that $Pr(NO_3)_3 \cdot 6H_2O$ in appropriate amounts was used in place of the $Ce(NO_3)_3 \cdot 6H_2O$ to provide the praseodymium-modified alumina samples of TABLE II containing the indicated molar amounts of Pr and Pd.

EXAMPLE 11

The activities of the catalysts prepared according to Examples 8–10 were measured in a quartz tube reactor. In each case a quantity of 0.06 grams of the catalyst was diluted in 2.94 grams of alpha-alumina and supported on a quartz frit. The reactant gas stream contained 1% methane in air. The reactor was heated in an electric tube furnace so that the catalyst bed ranged in temperature from room to about 1,000° C. The gas stream was monitored continuously for hydrocarbon content. The activity is defined as the catalyst bed temperature at which 30% of methane is combusted. The results are shown in TABLE II, which also shows thermal measurements made on an Omnitherm Atvantage II TGA951 instrument. The samples were heated at 20° C./minute in air. The decomposition temperatures ($T_D$) in the TABLE are those temperatures at which 80% of the weight loss sustained at temperatures greater than 700° C. has been completed.

TABLE II

| REO(1) (Moles) | Pd(2) (Moles) | Degrees Centigrade $T_A$(3) | $T_{D80}$(4) | $T_R$(5) | $T_D$-$T_R$(6) |
|---|---|---|---|---|---|
| La | | | | | |
| 0 | .004 | 334 | 889 | 638 | 251 |
| .002 | " | 368 | 912 | 598 | 314 |
| .004 | " | 354 | 900 | 587 | 313 |
| .008 | " | 378 | 916 | 735 | 181 |
| 0 | .008 | 324 | 921 | 635 | 286 |
| .002 | " | 328 | 916 | 621 | 295 |
| .004 | " | 324 | 917 | 610 | 307 |
| .008 | " | 352 | 920 | 730 | 190 |
| Ce | | | | | |
| .002 | .004 | 372 | 900 | 741 | 159 |
| .004 | " | 368 | 931 | 740 | 191 |
| .008 | " | 386 | 919 | 740 | 179 |
| .002 | .008 | 334 | 913 | 706 | 207 |
| .004 | " | 318 | 880 | 724 | 174 |
| .008 | " | 346 | 889 | 743 | 146 |
| Pr | | | | | |
| .002 | .004 | 364 | 927 | 600 | 327 |
| .004 | " | 360 | 927 | 608 | 319 |
| .008 | " | 366 | 954 | 589 | 365 |
| .002 | .008 | 330 | 920 | 700 | 220 |
| .004 | " | 330 | 920 | 719 | 201 |
| .008 | " | 354 | 919 | 710 | 209 |

(1) "REO" is the rare earth metal content of the samples in moles of the metal per ten grams of fresh alumina.

(2) "Pd" is the palladium metal content of the sample in moles of Pd per ten grams of fresh alumina.

(3) $T_A$ = Activity Temperature, the temperature (in degrees Centigrade) at which combustion of 30% (vol.) of the $CH_4$ present in a 1% (vol.) $CH_4$ in air mixture takes place at a 1.5 liters per minute flow rate through a sample of the catalyst.

(4) $T_{D80}$ = Decomposition Onset Temperature, the temperature (in degrees Centigrade) at which 80% of the weight loss attributed to PdO decomposition to Pd is attained.

(5) $T_R$ = Regeneration Onset Temperature, the temperature (in degrees Centigrade) at which regeneration of the catalyst by oxidation of Pd to PdO commences.

(6) $T_D$-$T_R$ represents the hysteresis discussed above.

The data of TABLE II show that although the inclusion of the lanthanide (rare earth) metal oxides in the alumina generally decreased the activity of the catalyst as indicated by the activity temperature with increasing addition of rare earth oxide, $T_{D80}$, the temperature at which 80% of the weight loss attributed to decomposition of the palladium oxide catalyst is attained, was increased by the presence of the rare earth oxide modifier. The catalyst attained by utilizing a lanthanide metal-modified alumina as the metal oxide support is more resistant to high temperatures and therefore would find use in the higher temperature zones of a catalytic combustion catalyst where its somewhat reduced activity would be more than offset by the increased temperature.

It will be noted that different definitions of Decomposition Onset Temperature, $T_D$, as defined in the footnote to TABLE I, and $T_{D80}$ as defined in footnote (4) of TABLE II are employed for, respectively, the unmodified (single compound) and modified (more than a single compound) metal oxide supports. This is because whereas the unmodified metal oxide supports such as those listed in TABLE I above exhibit sharp and definite Decomposition Onset Temperature, the modified metal oxide supports of the type illustrated in TABLE II exhibit decomposition over a broad temperature range, for example, palladium oxide on cerium-modified alumina supports exhibit decomposition temperature ranges of from about 80 to 131 degrees Centrigrade, depending on the palladium oxide loading and the atomic ratio of Ce to Pd. Accordingly, for modified metal oxide supports, the point at which 80% by weight of the total decomposition weight loss occurs was arbitrarily selected as the Decomposition Onset Temperature.

In the process of this invention, a carbonaceous fuel containing methane may be combusted with air in the presence of a catalyst composition containing palladium deposited as palladium oxide on a metal oxide support without any significant formation of NOx. Such catalytic combustion of the gaseous carbonaceous fuel is carried out by methods known in the prior art as illustrated in, for example, U.S. Pat. No. 3,928,961. In such a method, an intimate mixture of the fuel and air is formed, and at least a portion of this combustion mixture is contacted in a combustion zone with the catalyst composition of this invention, thereby effecting substantial combustion of at least a portion of the fuel. Conditions may be controlled to carry out the catalytic combustion under essentially adiabatic conditions at a rate surmounting the mass transfer limitation to form an effluent of high thermal energy. The combustion zone is at a temperature of from about 1,700° F. to about 3,000° F. and the combustion is generally carried out at a pressure of from 1 to 20 atmospheres.

The combustion catalyst of this invention may be used in a segmented catalyst bed such as described in, for example, U.S. Pat. No. 4,089,654. Dividing the catalyst configuration into segments is beneficial not only from an operational standpoint, but also in terms of monitoring the performance of various sections of the bed. The catalyst system comprises a catalyst configuration consisting of a downstream catalyst portion and an upstream catalyst portion protected therefrom.

Generally, the catalyst compositions used in the process of the invention may comprise a monolithic or unitary refractory steel alloy or ceramic substrate, such as a honeycomb-type substrate having a plurality of parallel, fine gas flow channels extending therethrough, the walls of which are coated with a palladium-containing catalyst composition, specifically, palladium oxide dispersed on a refractory metal oxide support as described above. Generally, the amount of palladium oxide in the catalyst will depend on the anticipated conditions of use. Typically, the palladium oxide content of the catalyst will be at least about 4 percent by weight of the total weight of palladium oxide and refractory metal oxide support (washcoat), calculated as palladium metal. The flow channels in the honeycomb substrate are usually parallel and may be of any desired cross section such as rectangular, triangular or hexagonal shape cross section. The number of channels per square inch may vary depending upon the particular applications, and monolithic honeycombs are commercially available having anywhere from about 9 to 600 channels per square inch. The substrate or carrier portion of the honeycomb desirably is a porous, ceramic-like material, e.g., cordierite, silica-alumina-magnesia, mullite, etc. but may be nonporous, and may be catalytically relatively inert.

While the invention has been described in detail with respect to specific preferred embodiments thereof, it will be appreciated by those skilled in the art that numerous variations thereto may be made which nonetheless lie within the spirit and scope of the invention and the appended claims.

What is claimed is:

1. A process for starting a combustion system to catalytically combust a gaseous carbonaceous fuel with air in a combustor in the presence of a palladium oxide-containing catalyst, which comprises:

(a) predetermining a decomposition onset temperature at which the palladium oxide-containing catalyst decomposes at an oxygen partial pressure equal to that found in the combustor;

(b) predetermining a reformation onset temperature at which the palladium oxide-containing catalyst will, at said same oxygen partial pressure found in the combustor, reform into palladium oxide after being subjected to the decomposition temperature;

(c) utilizing a flow of hot gases from a preburner to heat said catalyst to a temperature high enough to initiate combustion of said fuel with air upon contact with said catalyst;

(d) thereafter reducing the flow of hot gases from the preburner while supplying air and said fuel for combustion to the combustor downstream of said preheater; and (e) upon overheating of the catalyst to a first temperature in excess of the decomposition onset temperature of the catalyst, whereby the catalyst sustains a diminution of catalytic activity, thereafter restoring catalytic activity by lowering the temperature of the catalyst to a temperature not greater than the reformation onset temperature and maintaining the temperature at or below the reformation onset temperature until a desired degree of catalytic activity of the catalyst is achieved, and then maintaining the catalyst below the aforesaid decomposition onset temperature.

2. The process of claim 1 wherein the carbonaceous fuel comprises methane.

3. The process of claim 1 wherein combustion effluent discharged from the combustor is employed to run a gas turbine.

4. The process of claim 1 wherein the palladium oxide is supported on a metal oxide selected from the group consisting of ceria, titania, tantalum oxide and lanthanide metal oxide-modified alumina.

5. The process of claim 4 wherein the metal oxide comprises ceria and the reformation onset temperature at atmospheric pressure is about 730° C.

6. The process of claim 4 wherein the metal oxide comprises titania and the reformation onset temperature at atmospheric pressure is about 734° C.

7. The process of claim 4 wherein the metal oxide comprises tantalum oxide and the reformation onset temperature at atmospheric pressure is about 650° C.

8. The process of claim 4 wherein the metal oxide comprises a lanthanum oxide-modified alumina and the reformation onset temperature at atmospheric pressure is about 735° C.

9. The process of claim 4 wherein the metal oxide comprises a cerium oxide-modified alumina and the reformation onset temperature at atmospheric pressure is about 743° C.

10. The process of claim 4 wherein the metal oxide comprises a praseodymium oxide-modified alumina and the reformation onset temperature at atmospheric pressure is about 719° C.

11. A process for starting a combustion system to catalytically combust a carbonaceous fuel with air in a combustor in the presence of palladium oxide supported on a metal oxide support, which comprises utilizing a flow of hot gases from a preburner to heat said catalyst to a temperature high enough to initiate combustion of said fuel with air upon contact with said catalyst, thereafter reducing the flow of hot gases from the preburner while supplying air and fuel for combustion to the combustor downstream of said preheater, and, upon overheating of the catalyst to a first temperature in excess of at least about 775° C., at which first temperature catalyst deactivation occurs, thereafter restoring catalytic activity by lowering the temperature of the catalyst to a catalyst reactivation temperature which is lower than about 735° C. and maintaining the temperature at or below the catalyst reactivation temperature until desired catalytic activity is achieved, and thereafter maintaining the temperature of the catalyst below about 775° C.

12. The process of claim 11 including carrying out the process at atmospheric pressure.

13. The process of claim 11 or claim 12 wherein the carbonaceous fuel comprises methane.

14. The process of claim 12 wherein catalytic activity is restored by lowering the temperature of the catalyst into a reactivation temperature range which at atmospheric pressure is from about 600° C. to about 650° C.

15. The process of claim 12 wherein catalytic activity is restored by lowering the temperature of the catalyst into a reactivation temperature range which at atmospheric pressure is from about 650° C. to about 700° C.

16. The process of claim 14 or claim 15 wherein the metal oxide support is selected from the group consisting of ceria, titania and tantalum oxide.

17. The process of claim 11 wherein catalytic activity is restored by lowering the temperature of the catalyst into a reactivation temperature range which at atmospheric pressure is from about 675° C. to about 734° C.

18. The process of claim 11 wherein catalytic activity is restored by lowering the temperature of the catalyst into a reactivation temperature range which at atmospheric pressure is lower than about 744° C., and after the desired catalytic activity is achieved maintaining the temperature of the catalyst below about 775° C.

19. The process of claim 11 or claim 18 wherein the metal oxide support is selected from the group consisting of lanthanum oxide-modified alumina, cerium oxide-modified alumina and praseodymium oxide-modified alumina.

20. The process of claim 11 wherein combustion effluent discharged from the combustor is employed to run a gas turbine.

21. In a process for catalytic combustion of a mixture of a gaseous carbonaceous fuel and air by contacting the mixture with a catalyst comprising palladium oxide supported on a metal oxide support, wherein the catalyst for said catalytic combustion has been subjected to a temperature in excess of the temperature at which deactivation of the catalyst occurs, which temperature is at least about 775° C. at atmospheric pressure, the improvement comprising restoring catalytic activity by lowering the temperature of the catalyst into a regenerating temperature range at least about 44° C. below the deactivation temperature and maintaining the temperature within that range for a time sufficient to restore catalytic activity to said catalyst.

22. The process of claim 21 wherein the metal oxide support is selected from the group consisting of ceria, unmodified alumina, tantalum oxide and titanium oxide and in which the temperature at which deactivation of the catalyst occurs is at least about 775° C. when the metal oxide support comprises ceria, at least about 810° C. when the metal oxide support comprises alumina, at least about 810° C. when the metal oxide support comprises tantalum oxide, and at least about 814° C. when the metal oxide support is titanium oxide, and in which catalytic activity is restored by lowering the temperature of the catalyst into a regenerating temperature range which is below the temperature at which deactivation of the catalyst occurs by at least about 44° C. when the metal oxide support comprises ceria, by at least about 210° C. when the metal oxide support comprises unmodified alumina, by at least about 160° C. when the metal oxide support comprises tantalum oxide and by at least about 80° C. when the metal oxide support comprises titanium oxide.

23. The process of claim 21 or claim 22 wherein the carbonaceous fuel comprises methane.

24. The process of claim 21 or claim 22 wherein the combustion effluent discharged from the combustor is employed to run a gas turbine.

25. The process of claim 21 or claim 22 wherein the temperature in excess of the decomposition temperature is reached during start-up.

26. The process of claim 21 wherein the metal oxide support is selected from the group consisting of ceria, titania, tantalum oxide and lanthanide metal oxide-modified alumina.

27. The process of claim 26 wherein the lanthanide metal oxide is selected from the group consisting of cerium oxide, lanthanum oxide, praseodymium oxide and mixtures thereof.

28. The process of claim 21 wherein the metal oxide comprises ceria and restored catalytic activity is achieved by lowering the temperature of the catalyst into a reactivation temperature range which at atmospheric pressure is from about 700° C. to 730° C.

29. The process of claim 21 wherein the metal oxide comprises titania and restored catalytic activity is achieved by lowering the temperature of the catalyst into a reactivation temperature range which at atmospheric pressure is from about 660° C. to 734° C.

30. The process of claim 21 wherein the metal oxide comprises tantalum oxide and restored catalytic activity is achieved by lowering the temperature of the catalyst into a reactivation temperature range which at atmospheric pressure is from about 570° C. to 650° C.

31. The process of claim 21 wherein the metal oxide comprises a cerium oxide-modified alumina and restored catalytic activity is achieved by lowering the temperature of the catalyst into a reactivation temperature range which at atmospheric pressure is from about 516° C. to 743° C.

32. The process of claim 21 wherein the metal oxide of the catalytic material comprises a praseodymium oxide-modified alumina and restored catalytic activity is achieved by lowering the temperature of the catalyst into a reactivation temperature range which at atmospheric pressure is from about 470° C. to 767° C.

33. A process for the catalytically supported combustion of a gaseous carbonaceous fuel which comprises (a) forming a mixture of said fuel and air to provide a combustion mixture, (b) contacting said combustion mixture under conditions suitable for catalyzed combustion thereof with a catalyst composition comprising a catalytic material consisting essentially of a catalytically effective amount of palladium oxide dispersed on a metal oxide support selected from the group consisting of ceria, titania, tantalum oxide, cerium-modified alumina, lanthanum-modified alumina and praseodymium-modified alumina.

* * * * *

UNITED STATES PATENT AND TRADEMARK OFFICE

CERTIFICATE OF CORRECTION

PATENT NO. : 5,216,875
DATED : June 8, 1993
INVENTOR(S) : Kennelly, et al.

It is certified that error appears in the above-indentified patent and that said Letters Patent is hereby corrected as shown below:

On the title page item [75],

Inventors: Teresa Kennelly, Belle Mead; Robert J. Farrauto, Westfield; Melvin C. Hobson, Jr., Westfield; Earl M. Waterman, Vailsburg; all of N.J.

Signed and Sealed this

Eighteenth Day of October, 1994

Bruce Lehman

*Attest:*

BRUCE LEHMAN

*Attesting Officer*

*Commissioner of Patents and Trademarks*